US008558634B2

(12) United States Patent
Washiro

(10) Patent No.: US 8,558,634 B2
(45) Date of Patent: Oct. 15, 2013

(54) HIGH-FREQUENCY COUPLER AND COMMUNICATION DEVICE

(75) Inventor: Takanori Washiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 368 days.

(21) Appl. No.: 13/039,038

(22) Filed: Mar. 2, 2011

(65) Prior Publication Data

US 2011/0222585 A1 Sep. 15, 2011

(30) Foreign Application Priority Data

Mar. 12, 2010 (JP) ..... 2010-055639

(51) Int. Cl.
*H01P 5/04* (2006.01)
*H01Q 9/26* (2006.01)

(52) U.S. Cl.
USPC ..... 333/24 R; 333/220; 343/803

(58) Field of Classification Search
USPC ..... 333/24 R, 24 C, 219, 220, 245, 246; 343/793, 794, 795, 803, 816
See application file for complete search history.

(56) References Cited

U.S. PATENT DOCUMENTS

| | | | | |
|---|---|---|---|---|
| 7,605,764 | B2 * | 10/2009 | Ishimiya | 343/702 |
| 7,750,851 | B2 | 7/2010 | Washiro | |
| 8,198,960 | B2 * | 6/2012 | Washiro | 333/204 |
| 8,289,100 | B2 * | 10/2012 | Washiro | 333/24 R |
| 8,299,868 | B2 * | 10/2012 | Kato et al. | 333/24 R |
| 8,334,728 | B2 * | 12/2012 | Washiro | 333/24 R |
| 8,339,213 | B2 * | 12/2012 | Washiro | 333/24 R |
| 2008/0117117 | A1 | 5/2008 | Washiro | |
| 2011/0222586 | A1 | 9/2011 | Washiro | |
| 2011/0228814 | A1 | 9/2011 | Washiro | |
| 2011/0230136 | A1 | 9/2011 | Washiro | |

FOREIGN PATENT DOCUMENTS

JP 4345849 7/2009

OTHER PUBLICATIONS www.transferjet.org/index.html, 2009 Copyright Transfer Jet Consortium.

* cited by examiner

*Primary Examiner* — Dean O Takaoka
(74) *Attorney, Agent, or Firm* — Wolf, Greenfield & Sacks, P.C.

(57) ABSTRACT

A high-frequency coupler includes a ground, a coupling electrode which faces the ground and is supported so as to be separated by a negligible height with respect to the wavelength of a high-frequency signal, and a resonating unit for increasing a current flowing into the coupling electrode via a transmission path, in which the coupling electrode has bent portions in places where charges with a first polarity are accumulated so that charges with a second polarity are gathered in a front face when the high-frequency signal is input to the coupling electrode and a standing wave occurs, and an infinitesimal dipole is formed, and the high-frequency signal is transmitted toward a high-frequency coupler of a communication partner side arranged to face each other so that the angle θ formed in the direction of the infinitesimal dipole is substantially 0 degrees.

4 Claims, 7 Drawing Sheets

HIGH-FREQUENCY COUPLER AND COMMUNICATION DEVICE

CROSS REFERENCE TO RELATED APPLICATIONS

This application claims priority under 35 U.S.C. § 119 to Japanese Priority Patent Application JP 2010-055639, filed in the Japan Patent Office on Mar. 12, 2010, the entire contents of which are hereby incorporated by reference.

BACKGROUND OF THE INVENTION

1. Field of the Invention

The present invention relates to a high-frequency coupler and a communication device that perform large-volume data transmission in proximity through a weak UWB (Ultra Wide Band) communication method using a high-frequency wide-band, and particularly to a high-frequency coupler and a communication device that secure a communication range in the transverse direction in weak UWB communication using electric field coupling.

2. Description of the Related Art

Non-contact communication has been widely used as a medium for authentication information, electronic money, or other value information. For example, NFC (Near Field Communication) developed by Sony and Philips adopts the RFID (Radio-Frequency Identification) standard that defines the specification of NFC communication devices (reader and writer) that can communicate with IC cards of Type A, Type B, and FeliCa conforming with ISO/IEC 14443, uses 13.56 MHz band, and enables proximity type (0 to 10 cm or shorter: Proximity) non-contact bidirectional communication in a way of electromagnetic induction. In addition, in recent years, additional application of such non-contact communication systems can be found in large-volume data transmission such as downloading and streaming of moving images, music, or the like. Such large-volume data transmission can also be implemented by the operations of a single user, preferably completed within the same access time as used by the existing authentication or billing process, and therefore it is necessary to increase the communication rate.

The general RFID standard uses the 13.56 MHz band, is for proximity type (0 to 10 cm or shorter: Proximity) non-contact bidirectional communication adopting the main principle of electromagnetic induction, and employs a communication rate of about 106 kbps to 424 kbps. On the other hand, TransferJet (for example, refer to Japanese Patent No. 4345849 and www.transferjet.org/en/index.html) that uses weak UWB signals can be exemplified as a proximity wireless transfer technology applicable to high-speed communication. The proximity wireless transfer technology (TransferJet) is basically a method for transmitting signals by using the action of electric field coupling, and a high-frequency coupler of such a communication device includes a communication circuit unit that processes high-frequency signals, a coupling electrode that is arranged in a certain height apart from the ground, and a resonating unit that supplies high-frequency signals to the coupling electrode efficiently.

The proximity wireless transfer using the weak UWB has a communication distance of about 2 to 3 cm, only about as wide both in the longitudinal and transverse directions, is without polarized waves, and has a communication range in the shape of a substantially hemisphere dome. For that reason, it is necessary to activate electric field coupling effectively by facing the coupling electrodes appropriately to each other between communication devices for performing data transmission.

If a functioning unit of proximity wireless transfer is manufactured in a small size, the function will be suitable for incorporation, and can be mounted in various kinds of information equipment, for example, personal computers, mobile phones, or the like. However, if the size of a coupling electrode in a high-frequency coupler is reduced, there is a problem that the communication range diminishes particularly in the transverse direction. For example, if a target point, which indicates a spot where a high-frequency coupler is embedded, is marked on the housing surface of information equipment, a user may conduct an alignment aimed toward the target point. However, if the communication range of the transverse direction is narrow, a target point may be obscured by the shadow of the other equipment when they are adjacent, resulting that the target point is aligned while shifted from the center thereof in the transverse direction.

In order to improve usability in practical use of the proximity wireless transfer function, it is necessary to extend the communication range in the transverse direction. However, if the size of a coupling electrode in a high-frequency coupler is simply increased, a standing wave occurs on the surface of a coupling electrode. Then, since the electric fields of both directions are cancelled at a neighboring portion where the amplitude of the standing wave travels in opposite directions, places having the electric field with high intensity and low intensity appear. The place having the electric field with low intensity becomes a dead-point (null point) in which fine effect of electric field coupling is not easily obtained, even when the coupling electrode of a communication partner is contacted.

SUMMARY OF THE INVENTION

It is desirable for the present invention to provide an excellent high-frequency coupler and a communication device that enable the large-volume data transmission in proximity by a weak UVV communication method using a high-frequency wide-band.

It is further desirable for the invention to provide an excellent high-frequency coupler and a communication device that can secure a sufficient communication range in the transverse direction in proximity wireless transfer using the weak UWB without polarized waves.

According to an embodiment of the invention, there is provided a high-frequency coupler including a ground, a coupling electrode which faces the ground and is supported so as to be separated by a negligible height with respect to the wavelength of a high-frequency signal, and a resonating unit for increasing a current flowing into the coupling electrode via a transmission path, in which the coupling electrode has bent portions in places where charges with a first polarity are accumulated so that charges with a second polarity are gathered in a front face toward a radiating direction of an electric field when the high-frequency signal is input to the coupling electrode via the transmission path and a standing wave occurs, and an infinitesimal dipole constituted by a line connecting the center of the charges accumulated in the coupling electrode and the center of mirror-image charges accumulated in the ground is formed, and the high-frequency signal is transmitted toward a high-frequency coupler of a communication partner side arranged to face each other so that the angle θ formed in the direction of the infinitesimal dipole is substantially 0 degrees.

According to the embodiment of the invention, the high-frequency coupler has bent portions which are formed in portions of every odd-numbered fold of about ½ of the wavelength from a tip of the coupling electrode.

According to another embodiment of the invention, there is provided a communication device including a communication circuit unit which performs a process of a high-frequency signal transmitting data, a transmission path of a high-frequency signal connected to the communication circuit unit, a ground, a coupling electrode which faces the ground and is supported so as to be separated by a negligible height with respect to the wavelength of the high-frequency signal, and a resonating unit for increasing the current flowing into the coupling electrode via the transmission path, in which the coupling electrode has bent portions in places where charges with a first polarity are accumulated so that charges with a second polarity are gathered in a front face toward a radiating direction of an electric field when the high-frequency signal is input to the coupling electrode via the transmission path and a standing wave occurs, and an infinitesimal dipole constituted by a line connecting the center of the charges accumulated in the coupling electrode and the center of mirror-image charges accumulated in the ground is formed, and the high-frequency signal is transmitted toward a high-frequency coupler of a communication partner side arranged to face each other so that the angle θ formed in the direction of the infinitesimal dipole is substantially 0 degrees.

According to the embodiment of the invention, the communication device has the bent portions which are formed in portions of every odd-numbered fold of about ½ of the wavelength from a tip of the coupling electrode.

According to an embodiment of the invention, there is provided an excellent high-frequency coupler and a communication device that enable large-volume data transmission in proximity by a weak UWB communication method using a high-frequency wide-band.

According to an embodiment of the invention, there is provided an excellent high-frequency coupler and a communication device that can secure a sufficient communication range in the transverse direction in proximity wireless transfer using the weak UWB without polarized waves.

According to an embodiment of the invention, there is provided an excellent high-frequency coupler and a communication device that can expand the communication range particularly in the transverse direction by increasing the size of a coupling electrode and radiating an electric field signal in a wide range.

According to an embodiment of the invention, a dead-point (null point) where the effect of electric field coupling is not exhibited can be removed by forming bent portions in places where charges with the polarity of the coupling electrode are accumulated so that charges with the same opposite polarity are gathered in the front direction toward the radiating direction of an electric field, and by preventing cancellation of the electric fields in adjacent portions having accumulated charges with opposite polarities. As a result, the communication range can be expanded particularly in the transverse direction by increasing the size of the coupling electrode and radiating an electric field signal in a wide range.

According to an embodiment of the invention, since the communication range can be expanded in the transverse direction mainly from the center of the coupling electrode, users can conduct stable communication even without having to bring the marks of the target points into close proximity for alignment when, for example, the information equipment incorporated with high-frequency couplers are made to face each other.

Other goal, characteristics, and advantages of the invention will be clarified by detailed descriptions based on embodiments of the invention to be described later and by accompanying drawings.

DESCRIPTION OF THE PREFERRED EMBODIMENTS

Hereinbelow, an embodiment of the present invention will be described in detail with reference to drawings.

First, the operation principle of proximity wireless transfer by a weak UWB communication method will be described.

Figure 1:
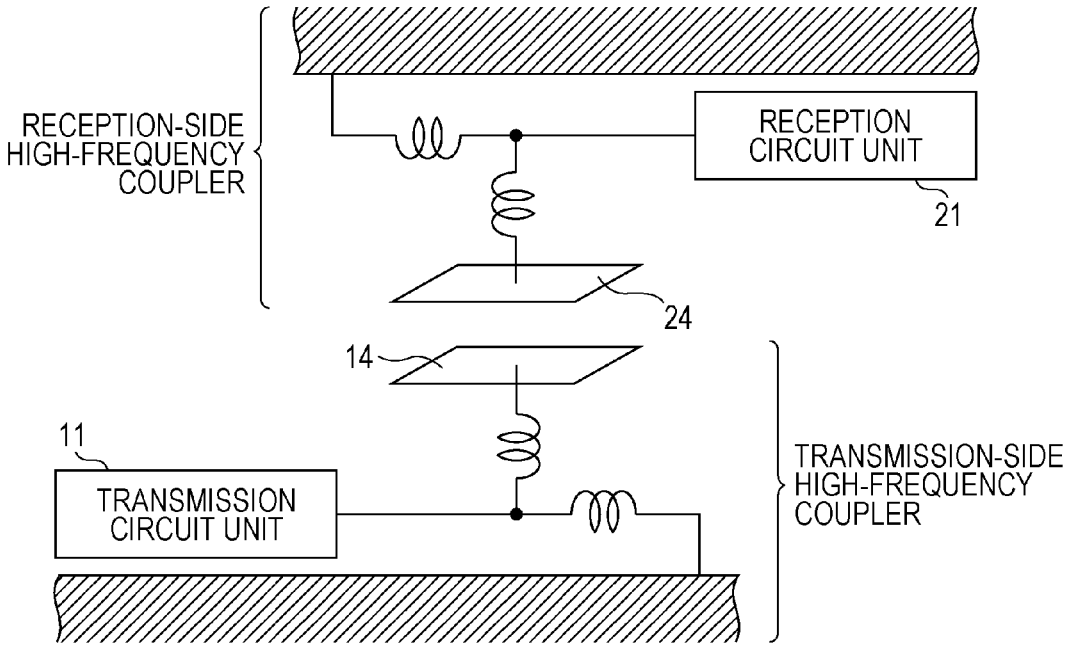
FIG. 1 is a diagram schematically illustrating the configuration of a proximity wireless transfer system by a weak UWB communication method.

FIG. 1 is a diagram schematically illustrating the composition of a proximity wireless transfer system in the weak UWB communication method using the action of electric field coupling. In the same drawing, coupling electrodes 14 and 24 used in transmission and reception that belong to a transmitter 10 and a receiver 20 respectively are arranged apart, for example, by about 3 cm (or about ½ of the wavelength of the frequency band being used) from each other in an opposed manner so as to enable electric field coupling. The transmission circuit unit 11 in the transmitter side generates high-frequency transmission signals such as UWB signals based on transmission data when a transmission request is made from an higher level application, and the signals penetrate from the transmitting electrode 14 to the receiving electrode 24 as electric field signals. In addition, the reception circuit unit 21 in the receiver 20 side performs the processes of demodulation and decoding for the received high-frequency electric field signals and passes the produced data to the upper application.

If the UWB is used in the proximity wireless transfer, ultra-high-speed data transfer of 100 Mbps can be realized. In addition, in the proximity wireless transfer, the coupling action of an electrostatic field or an induced electric field is used as described later, not a radiated electric field. Since the intensity of an electric field is in proportion to the cube or the square of a distance, a proximity wireless transfer system can be used as weak wireless unnecessary with license from a radio station by suppressing the intensity of the electric field to a certain level or lower within a distance of 3 meters from the wireless facility and formed at a low cost. In addition, since data communication is performed in the electric field coupling method in the proximity wireless transfer, it is advantageous in that interference influences only slightly as reflected waves from reflective objects in the peripheral environment are small, and that consideration of preventing hacking or securing confidentiality on the transmission path is not necessary.

On the other hand, in wireless communication, the propagation loss gets greater according to the extent of the distance that the wavelength propagates. In the proximity wireless transfer that uses high-frequency wide-band signals as the UWB signals, the communication distance of about 3 cm is equivalent to ½ of the wavelength. In other words, the communication distance can be said to be proximal but is a length that is not negligible, and therefore, the propagation loss is necessary to be suppressed to a sufficiently low level. Above all, a high-frequency circuit has a more serious problem in characteristic impedance in comparison to a low-frequency circuit, and has significant influence caused by impedance mismatch in the coupling point between the electrodes of the transmitter and the receiver.

For example, in the proximity wireless transfer system shown in FIG. 1, even if the transmission path of high-frequency electric field signals connecting the transmission circuit unit 11 and the transmitting electrode 14 is on a coaxial line where 50Ω of impedance is matched, the electric field signals are reflected causing propagation losses when the impedance in the coupling portion between the transmitting electrode 14 and the receiving electrode 24 is mismatched, thereby lowering communication efficiency.

Figure 2:
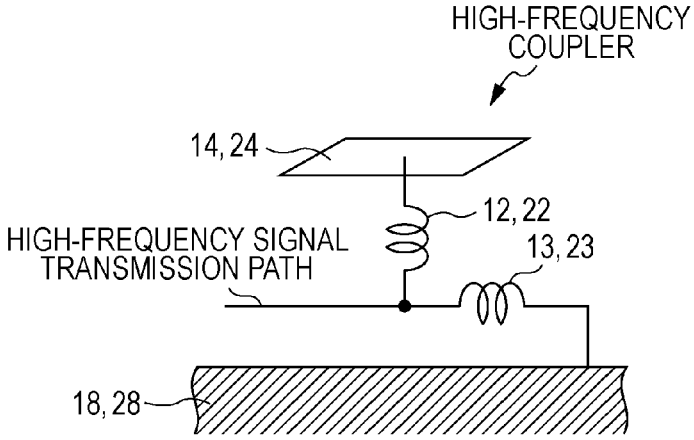
FIG. 2 is a diagram illustrating the basic composition of a high-frequency coupler where a transmitter and a receiver are arranged.

Accordingly, as shown in FIG. 2, the high-frequency coupler arranged in each of the transmitter 10 and the receiver 20 is configured such that plate-shaped electrodes 14 and 24 and a resonating unit that includes series inductors 12 and 22 and parallel inductors 13 and 23 are connected to a high-frequency signal transmission path. The high-frequency signal transmission path referred here can be constituted by a coaxial cable, a micro-strip line, a coplanar line or the like. If high-frequency couplers of such a kind are arranged to face each other, a coupling portion acts as a band-pass filter in extreme proximity where a quasi-electric field is dominant, thereby high-frequency signals can be transferred. In addition, even in a distance that is not negligible with respect to a wavelength and an induced electric field is dominant, the high-frequency signals can be transferred efficiently between two high-frequency couplers via an induced electric field generated from an infinitesimal dipole (described later) formed by charges and mirror-image charges respectively accumulated in the coupling electrode and the ground.

Hence, if it is aimed to simply match impedance and only suppress reflected waves between the electrodes of the transmitter 10 and the receiver 20, that is, in the coupling portion, the impedance in the coupling portion can be designed to be continuous even when each coupler employs a simple configuration where the plate-shaped electrodes 14 and 24 and the series inductors 12 and 22 are in series connection on the high-frequency signal transmission path. However, since characteristic impedance in the front and rear parts of the coupling portion does not change, the current amplitude does not change. With respect to the point, bigger charges can be sent to the coupling electrode 14 by providing the parallel inductors 13 and 23, and strong electric field coupling action can occur between the coupling electrodes 14 and 24. In addition, a large electric field is induced around the surface of the coupling electrode 14, and the generated electric field propagates from the surface of the coupling electrode 14 to the front direction (the direction of the infinitesimal dipole to be described later) as an electric field signal of an oscillating longitudinal waves. The waves of the electric field enable the electric field signal to propagate even when the distance between the coupling electrodes 14 and 24 (phase height) is relatively long.

To summarize, vital conditions of a high-frequency coupler in a proximity wireless transfer system by a weak UWB communication method are as follows.

(1) To provide a coupling electrode facing the ground in order to perform coupling with an electric field at a location separated from the wavelength of a high-frequency signal by a negligible height (2) To provide a resonating unit in order to perform coupling with a stronger electric field (3) To set a constant of a capacitor by series/parallel inductors and a coupling electrode or the height of a stub so as to take impedance matching when coupling electrodes are placed to face each other in a frequency band used for communication.

When the coupling electrodes 14 and 24 of the transmitter 10 and the receiver 20 are faced with an appropriate distance apart from each other in the proximity wireless transfer system shown in FIG. 1, two high-frequency couplers operate as a band-pass filter through which electric field signals pass in a predetermined high-frequency band, and a single high-frequency coupler acts as an impedance converting circuit that amplifies currents, thereby flowing currents with high amplitude in the coupling electrodes. On the other hand, when the high-frequency coupler is independently placed in a free space, the input impedance of the high-frequency coupler does not correspond to a characteristic impedance on the high-frequency signal transmission path, the signal that enters into the high-frequency signal transmission path is reflected in the high-frequency coupler, but not emitted to the outside, and therefore, the signal does not give influence on other neighboring communication systems. In other words, when there is no communication partner, the transmitter does not release radio waves as antennas of the past did, and high-frequency electric field signals are transferred by taking impedance matching only when the communication partner gets closer.

Figure 3:
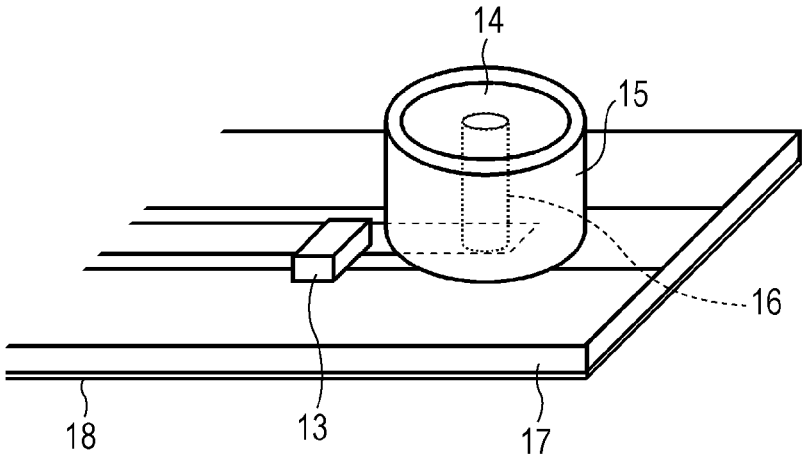
FIG. 3 is a diagram illustrating an embodiment of the high-frequency coupler shown in FIG. 2.

FIG. 3 shows an embodiment of the high-frequency coupler shown in FIG. 2. Both of the high-frequency couplers of the transmitter 10 and the receiver 20 can be configured in the same manner. In the drawing, the coupling electrode 14 is provided on the top surface of a spacer 15 made of a dielectric, and electrically connected to the high-frequency signal transmission path on the printed board 17 via a through-hole 16 penetrating the spacer 15. In the same drawing, the spacer 15 has a substantially cylindrical shape, and the coupling electrode 14 has a substantially circular shape, but neither of them is limited to a specific shape.

For example, after a dielectric having a desired height is formed with the through-hole 16 therein, the through-hole 16 is filled with a conductor, and a conductor pattern to be the coupling electrode 14 is deposited on the top surface of the dielectric using, for example, by a plating technique. In addition, a wiring pattern serving as the high-frequency signal transmission path is formed on the printed board 17. Then, the high-frequency coupler can be made by mounting the spacer 15 on the printed board 17 by conducting reflow soldering. The appropriate adjustment of the height from the circuit-mounted surface on the printed board 17 (or the ground 18) to the coupling electrode 14, that is, the length of the through-hole 16 (phase height) in accordance with a wavelength to be used makes it possible for the through-hole 16 to have inductance and to be substituted for the series inductor 12 shown in FIG. 2. In addition, the high-frequency signal transmission path is connected to the ground 18 via the chip-shaped parallel inductor 13.

Herein, the electromagnetic field generated in the coupling electrode 14 in the side of the transmitter 10 will be discussed.

As shown in FIGS. 1 and 2, the coupling electrode 14 is connected to one end of the high-frequency signal transmission path, and accumulates charges with high-frequency signals that are output from the transmission circuit unit 11 and flow therein. At this moment, the charges flowing into the coupling electrode 14 via the transmission path are amplified by a resonating effect of the resonating unit formed of the series inductor 12 and the parallel inductor 13, and larger charges are accumulated.

In addition, the ground 18 is provided separated from the wavelength of the high-frequency signal by a negligible height (phase height) so as to face the coupling electrode 14. Then, if charges are accumulated in the coupling electrode 14 as described above, mirror-image charges are accumulated in the ground 18. If point charges Q are placed outside the planar conductor, mirror-image charges −Q (which is virtual and replaces the surface charge distribution) are provided in the planar conductor, but this matter is the related art as described in, for example, "Electromagnetics" written by Tadashi Mizoguchi (pp. 54 to 57, Shokabo).

As a result of the point charges Q and the mirror-image charges −Q being accumulated as described above, the infinitesimal dipole formed by a line connecting the center of the charges accumulated in the coupling electrode 14 and the center of the mirror-image charges accumulated in the ground 18 is formed. Strictly speaking, the charges Q and the mirror-image charges −Q have the volume, and the infinitesimal dipole is formed so that the center of the charges and the center of the mirror-image charges are connected to each other. The "infinitesimal dipole" mentioned here refers to "a dipole that has a very short distance between charges of an electric dipole". For example, "Antennas and Propagation" written by Yasuto Mushiake (pp. 16 to 18, Corona) also describes the "infinitesimal dipole". In addition, the infinitesimal dipole causes to generate a transverse wave component $E_\theta$ of the electric field, a longitudinal wave component $E_R$ of the electric field, and a magnetic field $H_\phi$ in the circumference of the infinitesimal dipole.

Figure 4:
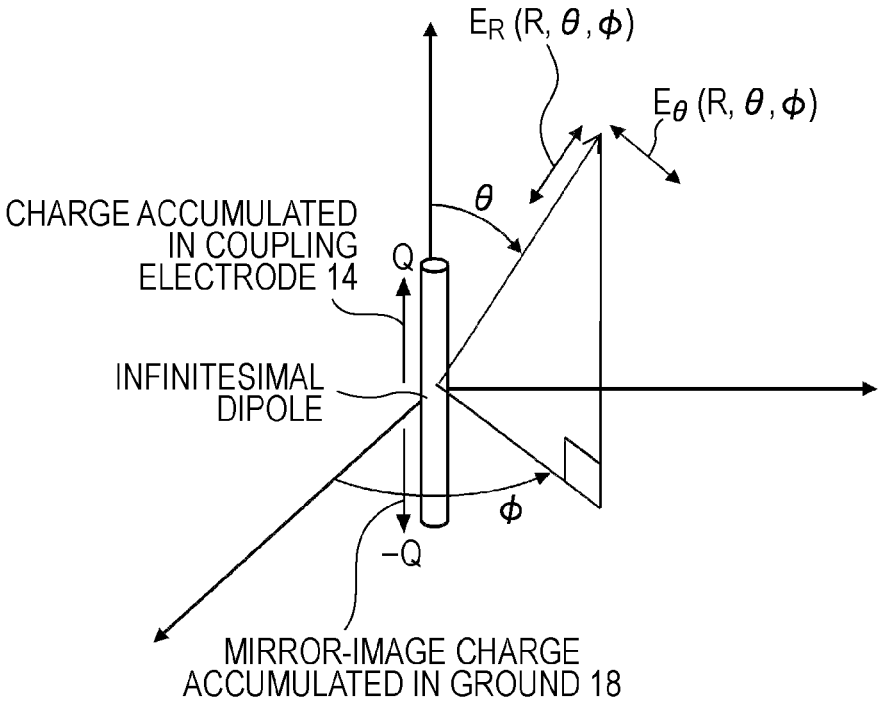
FIG. 4 is a diagram showing an electric field by an infinitesimal dipole.
Figure 5:
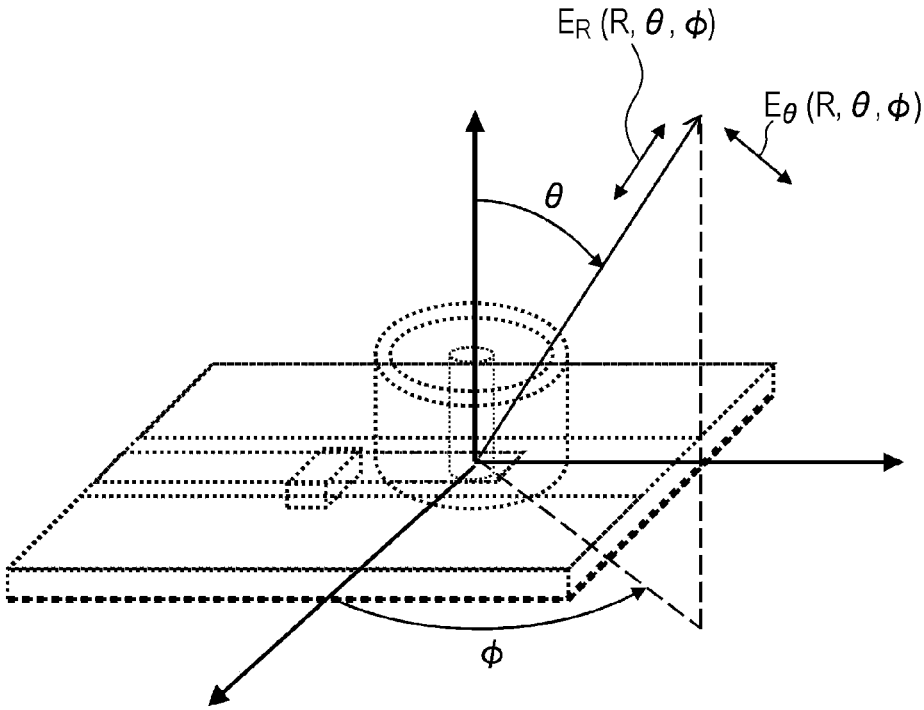
FIG. 5 is a diagram in which the electric field shown in FIG. 4 is matched on a coupling electrode.

FIG. 4 shows the electric field of the infinitesimal dipole. In addition, FIG. 5 illustrates the state where the electric field is matched on the coupling electrode. As shown in the drawings, the transverse wave component $E_\theta$ of the electric field oscillates in a direction perpendicular to the propagating direction, and the longitudinal wave component $E_R$ of the electric field oscillates in parallel with the propagating direction. In addition, the magnetic field $H_\phi$ is generated in the circumference of the infinitesimal dipole. Formulas (1) to (3) below express the electromagnetic field generated by the infinitesimal dipole. In the formulas, the component in inverse proportion to the cube of the distance R is a static electromagnetic field, the component in inverse proportion to the square of the distance R is an induced electromagnetic field, and the component in inverse proportion to the distance R is a radiated electromagnetic field.

$$E_\theta = \frac{pe^{-jkR}}{4\pi\varepsilon}\left(\frac{1}{R^3} + \frac{jk}{R^2} - \frac{k^2}{R}\right)\sin\theta \tag{1}$$

$$E_R = \frac{pe^{-jkR}}{2\pi\varepsilon}\left(\frac{1}{R^3} + \frac{jk}{R^2}\right)\cos\theta \tag{2}$$

$$H_\phi = \frac{j\omega pe^{-jkR}}{4\pi}\left(\frac{1}{R^2} + \frac{jk}{R}\right)\sin\theta \tag{3}$$

In order to suppress interfering waves to peripheral systems, it is preferably considered that the transverse wave $E_\theta$ that includes the component of the radiated electric field is suppressed and the longitudinal wave $E_R$ that does not include the component of the radiated electric field is used in the proximity wireless transfer system shown in FIG. 1. The reason is because the transverse wave component $E_\theta$ of the electric field includes the radiated electric field that is in inverse proportion to a distance (in other words, that shows slight reduction in a distance), but the longitudinal wave component $E_R$ does not include the radiated electric field, as understood from the formulas (1) and (2) above.

Figure 6:
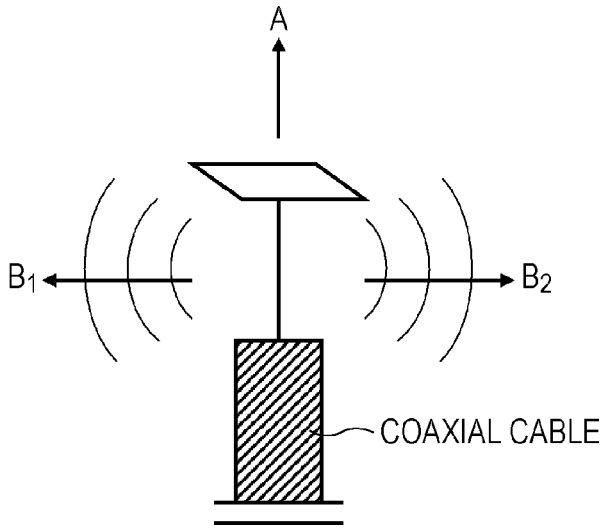
FIG. 6 is a diagram illustrating the composition example of a capacity-loaded type antenna.

First of all, in order not to bring about the transverse wave $E_\theta$ of the electric field, it is necessary for the high-frequency coupler not to operate as an antenna. The high-frequency coupler shown in FIG. 2 has a similar structure to a "capacity-loaded type" antenna that has electrostatic capacity by attaching metal on the tip of an antenna element and of which the height is reduced. Therefore, it is necessary for the high-frequency coupler not to operate as a capacity-loaded type antenna. FIG. 6 shows a composition example of the capacity-loaded type antenna, and the longitudinal wave component $E_R$ of the electric field is generated largely in the direction of Arrow A and the transverse wave $E_\theta$ of the electric field is generated in the directions of Arrows $B_1$ and $B_2$.

In the composition example of the coupling electrode shown in FIG. 3, the dielectric 15 and the through-hole 16 play both roles of avoiding the coupling of the coupling electrode 14 and the ground 18 and of forming the series inductor 12. The electric coupling of the ground 18 and the electrode 14 is avoided and the effect of the electric coupling with the high-frequency coupler of the receiver side is secured by configuring the series inductor 12 with a sufficient height from the circuit mounting surface on the printed board 17 to the electrode 14. However, if the height of the dielectric 15 is high, in other words, if the distance from the circuit mounting surface on the printed board 17 to the electrode 14 has a length that is not able to be negligible for the used wavelength, the high-frequency coupler acts as a capacity-loaded type antenna, and thus the transverse wave $E_\theta$ is generated as indicated by Arrows $B_1$ and $B_2$ in FIG. 6. Therefore, there are conditions that the height of the dielectric 15 is to be a sufficient length for forming the series inductor 12 necessary for acquiring characteristics as a high-frequency coupler by avoiding coupling of the electrode 14 and the ground 18 and for acting as an impedance matching circuit, and is short to the extent that unnecessary electric waves $E_\theta$ by the current flowing the series inductor 12 are not radiated heavily.

On the other hand, it is understood from the formula (2) that the longitudinal wave component $E_R$ is maximized when the component forms an angle $\theta=0$ with the direction of the infinitesimal dipole. Therefore, in order to conduct non-contact communication by using the longitudinal wave component $E_R$ of the electric field, high-frequency electric field signals are preferably transmitted by placing the high-frequency coupler of the communication partner in an opposed manner so that the angle $\theta$ formed with the direction of the infinitesimal dipole is about 0 degrees.

In addition, the current of the high-frequency signals flowing into the coupling electrode 14 can be greater by the resonating unit formed of the series inductor 12 and the parallel inductor 13. As a result, the moment of the infinitesimal dipole formed by the charges accumulated in the coupling electrode 14 and the mirror-image charges in the ground side can be greater, and the high-frequency electric field signals formed of the longitudinal wave $E_R$ can be efficiently radiated toward the propagating direction where the angle $\theta$ formed with the direction of the infinitesimal dipole is about 0 degrees.

In the high-frequency coupler shown in FIG. 2, the operating frequency $f_0$ is decided in an impedance matching unit by constants $L_1$ and $L_2$ of the parallel inductor and the series inductor. However, generally, since the band of a lumped constant circuit is narrower than that of a distributed constant circuit in a high-frequency circuit, and the constant of an inductor gets smaller as the frequency gets higher, it is problematic in that the resonating frequency is deviated by unevenness in the constants. With regard to this matter, it can be considered that a wider bandwidth is realized with a solution that the high-frequency coupler is constituted by replacing the lumped constant circuit with the distributed constant circuit in the impedance matching unit and the resonating unit.

Figure 7:
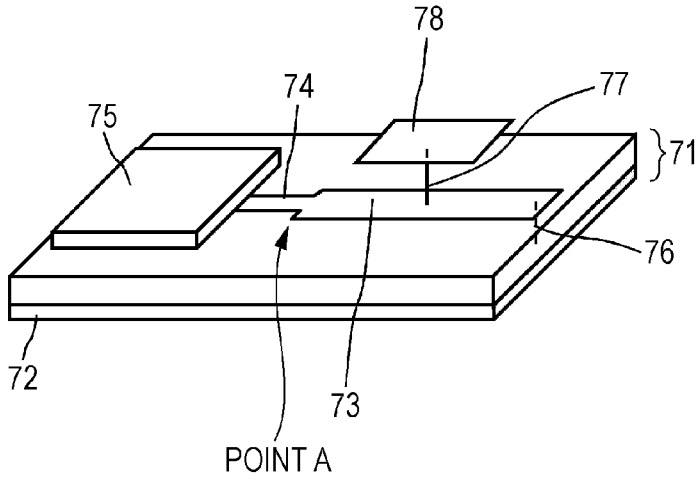
FIG. 7 is a diagram illustrating the composition example of the high-frequency coupler using a distributed constant circuit in a resonating unit.

FIG. 7 shows a composition example of a high-frequency coupler in which a distributed constant circuit is used for the impedance matching unit and the resonating unit. In the example shown in the drawing, a high-frequency coupler is provided where a ground conductor 72 is formed on the bottom surface, and a printed board 71 formed with a printed pattern is arranged on the top surface. As the impedance matching unit and the resonating unit of the high-frequency coupler, a micro-strip line or a coplanar waveguide, that is, a stub 73 is formed as a distributed constant circuit instead of a parallel inductor and a series inductor, and is connected to a transmission/reception circuit module 75 via a signal line pattern 74. The stub 73 is connected and short-circuited to the ground 72 in the bottom surface via a through-hole 76 penetrating the printed board 71 at the tip of the stub. In addition, around the center of the stub 73, a coupling electrode 78 is connected thereto via one terminal 77 formed of a thin metal line.

Furthermore, "stub" referred to in the technological field of electrical engineering is a collective term of electric wires of which one end is connected, and the other end is not connected or ground-connected, and provided in the middle of a circuit for the use of adjustment, measurement, impedance matching, filter, or the like.

Figure 8:
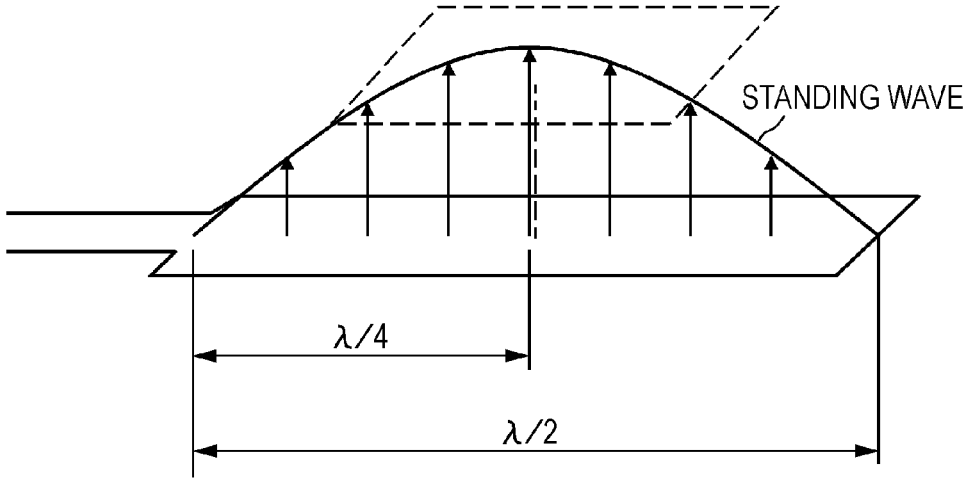
FIG. 8 is a diagram showing the state where a standing wave occurs on a stub in the high-frequency coupler shown in FIG. 7.

The signal input from the transmission/reception circuits via the signal line is reflected in the tip portion of the stub 73 and a standing wave occurs in the stub 73. The phase height of the stub 73 is about ½ of the wavelength of the high-frequency signal (180 degrees in terms of phase), the signal line 74 and the stub 73 are formed of the micro-strip line, coplanar line, and the like on the printed board 71. As shown in FIG. 8, when the tip is short-circuited with the phase height of the stub 73 of ½ of the wavelength, the voltage magnitude of the standing wave occurring in the stub 73 is 0 at the tip of the stub 73, and reaches the maximum at the center of the stub 73, that is, a point ¼ of the wavelength (90 degrees) from the tip of the stub 73. If a coupling electrode 78 is connected to one terminal 77 around the center of the stub 73 where the voltage magnitude of the standing wave reaches the maximum, a high-frequency coupler having excellent propagating efficiency can be made.

Since the stub 73 shown in FIG. 7 is the micro-strip line or the coplanar waveguide on the printed board 71, and the DC resistance is small, the high-frequency signal has little loss, and therefore, propagation loss between the high-frequency couplers can be reduced. In addition, since the size of the stub 73 constituting the distributed constant circuit is as large as ½ of the wavelength of the high-frequency signal, errors in the dimension due to tolerance during the production are very slight relative to the entire phase height, and unevenness in characteristics does not easily occur.

Subsequently, a method of expanding the communication range will be considered in the proximity wireless transfer using the weak UWB.

When the proximity wireless transferring function is applied to be incorporated into information equipment, a user is not able to see the mark of the target point attached on the housing of the equipment for the purpose of aligning, and the equipment contact deviates in the transverse direction from the center. For this reason, in order to improve the advantage of the proximity wireless transferring function in practical use, it is necessary to expand the communication range in the transverse direction.

Figure 9:
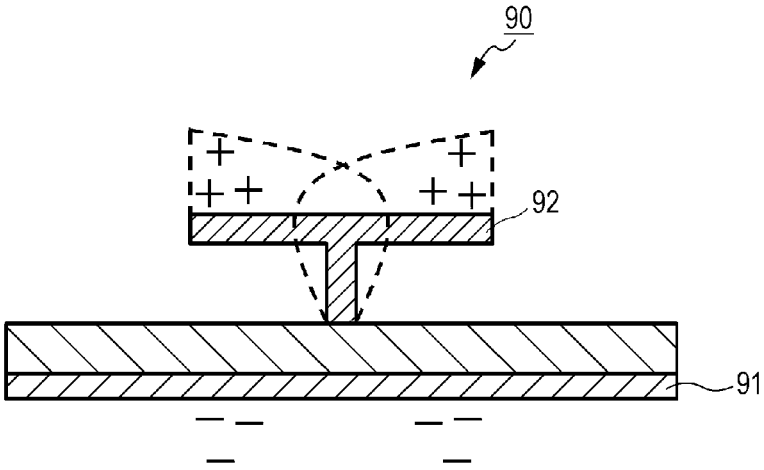
FIG. 9 is a diagram showing the state where charges are accumulated in a coupling electrode in a high-frequency coupler where the coupling electrode is mounted on a ground circuit when the coupling electrode is input with high-frequency signals.

FIG. 9 shows the state of a high-frequency coupler 90 formed by mounting a coupling electrode 92 on a ground board 91, in which charges are accumulated in the coupling electrode when a high-frequency signal is input into the coupling electrode. As shown by the drawing, the amount of the charges accumulated in the coupling electrode 92 changes in the form of a sine wave. In the high-frequency band of a GHz class of which the wavelength is as short as the UWB, the size of a coupling electrode becomes non-negligibly high relative to the wavelength. For this reason, distribution of charges such as a standing wave occurs on the coupling electrode 92. In addition, in the same drawing, the electric field occurring from the coupling electrode 92 is indicated by dotted lines.

In the example of FIG. 9, in terms of the size of the coupling electrode 92, the height from the root implanted in the ground board 91 to the tip is designed to be ¼ of the wavelength. In addition, the tip of the coupling electrode 92 is in an open state. The open state corresponds to the fixed end of the standing wave of the current, and to an anti-node where the amplitude of the sine wave of the charges accumulated in the tip portion reaches the maximum. In that case, the charges accumulated in each portion of the coupling electrode 92 have the same polarity at all times. In addition, the ground board 91 accumulates mirror-image charges with reverse polarity according to the charges accumulated in each portion.

A simple method of expanding the communication range of a high-frequency coupler in the transverse direction is to increase the size of the coupling electrode. However, if the size of the coupling electrode in a high-frequency coupler is increased, a standing wave occurs on the surface of the coupling electrode, and, in addition to a place where charges with the same polarity are accumulated in the front direction toward the radiating direction of an electric field, a place where charges with the opposite polarity are accumulated appears. Then, since the electric fields of each polarity are cancelled in adjacent places where the amplitude of the standing wave faces in opposite directions, places with a high intensity and a low intensity of the electric field occur. The place with low intensity of the electric field becomes a dead-point (null point) where an excellent effect of electric field coupling is not easily obtained even when the coupling electrode of a communication partner comes into contact.

Figure 10:
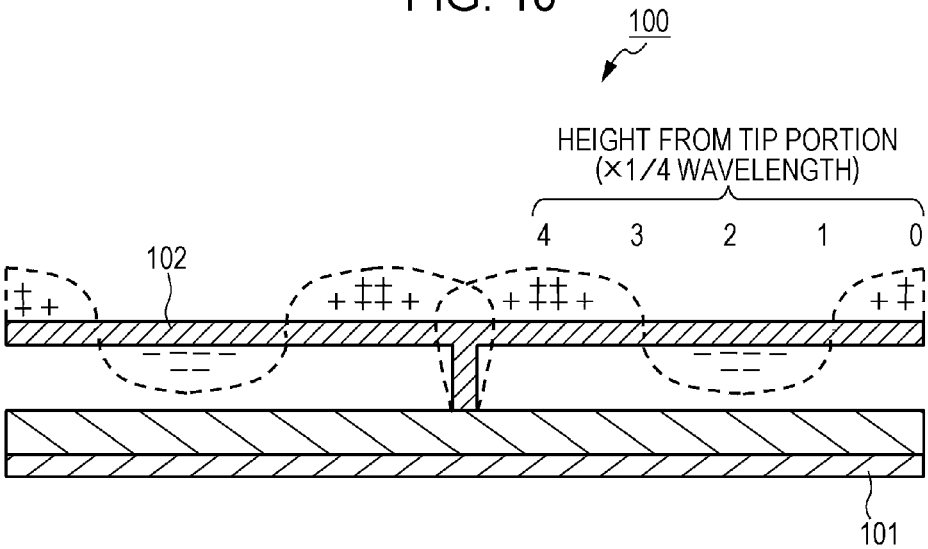
FIG. 10 is a diagram showing the state where charges are accumulated in a coupling electrode in a high-frequency coupler where the coupling electrode having the length from the root to the tip of ½ of the wavelength or more is mounted in a ground circuit when the coupling electrode is input with high-frequency signals.

FIG. 10 shows the state of a high-frequency coupler 100 formed by mounting a coupling electrode 102 having the height from the root to the tip of ½ of the wavelength or higher on a ground board 101, in which charges are accumulated in the coupling electrode 102 when a high-frequency signal is input into the coupling electrode 102. As shown by the same drawing, the amount of the charges accumulated in the coupling electrode 102 changes in the form of a sine wave. In the high-frequency band of a GHz class of which the wavelength is short as the UWB, the size of a coupling electrode becomes non-negligibly high relative to the wavelength. For this reason, distribution of charges, such as a standing wave, occurs on the coupling electrode 102. In addition, in the same drawing, the electric field occurring from the coupling electrode 102 is indicated by dotted lines.

The tip of the coupling electrode 102 is in the open state, and charges accumulated in the tip portion correspond to an anti-node where the amplitude of the sine wave reaches the maximum. FIG. 10 shows the length of the coupling electrode 102 from the tip portion with ¼ of the wavelength as one unit. When the standing wave occurs, places where charges with different polarities are gathered are alternately formed on the coupling electrode 102. In other words, charges with the same polarity are gathered in portions of every one wavelength (in other words, portions of 0-fold, 4-fold, 8-fold, . . . of ¼ of the wavelength) from the tip of the coupling electrode 102 as an anti-node where the amplitude of the sine wave reaches the maximum, and charges with the difference polarity from the above are gathered in portions of every odd-numbered fold of ½ of the wavelength (in other words, portions of 2-fold, 6-fold, 10-fold, . . . of ¼ of the wavelength) from the tip of the coupling electrode 102 as an anti-node where the amplitude of the sine wave reaches the maximum. Then, the polarity of the charges is reversed in each place where the distance from the tip of the coupling electrode 102 is every odd-numbered fold of ¼ of the wavelength. For this reason, electric fields in both adjacent places where the polarities of accumulated charges are opposite are cancelled.

Figure 11:
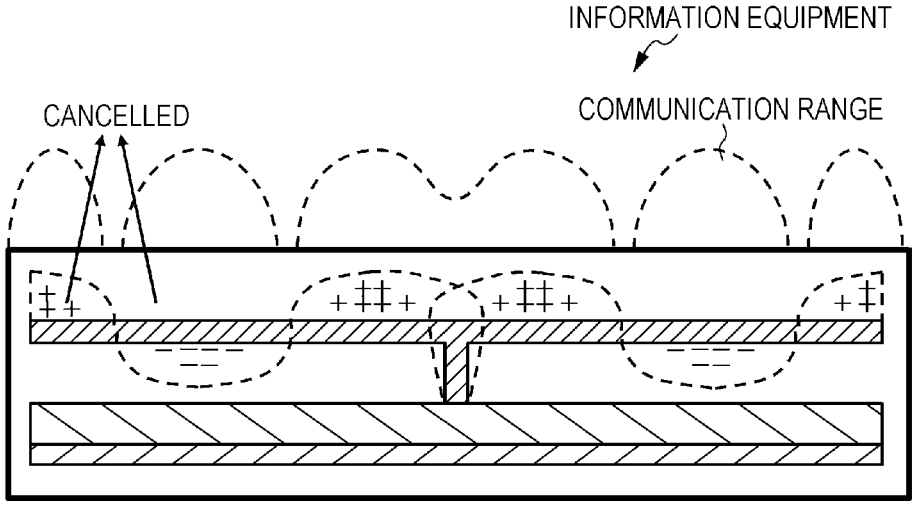
FIG. 11 is a diagram showing the state where the high-frequency coupler shown in FIG. 10 is accommodated in information equipment.

FIG. 11 shows the state where the high-frequency coupler 100 shown in FIG. 10 is accommodated in information equipment. In addition, in the same drawing, the electric field occurring from the coupling electrode 102 is indicated by dotted lines. The range within which the electric field radiated from the housing surface of the information equipment reaches is the communication range. As shown in the drawing, as a result of cancelling the electric fields in both adjacent places where the polarities of accumulated charges are opposite on the coupling electrode 102, places with high and low intensities of the electric field are generated. Therefore, the place with low intensity of the electric field becomes a dead-point (null point) where an excellent effect of electric field coupling is not easily obtained even when the coupling electrode of a communication partner comes into contact.

Furthermore, in order to simplify the drawings, mirror-image charges occurring on the ground board 101 are not depicted in FIGS. 10 and 11. Please understand that mirror-image charges are distributed on the ground board 101 with reversed polarities in the same size as the charges accumulated in the coupling electrode 102.

The charges with the same polarity are generated in portions of every one wavelength (in other words, portions of 0-fold, 4-fold, 8-fold, . . . of ¼ of the wavelength) from the tip of the coupling electrode 102 as an anti-node where the amplitude of the sine wave reaches the maximum, and the charges with the opposite polarity to the above are generated in portions of every odd-numbered fold of ½ of the wavelength (in other words, portions of 2-fold, 6-fold, 10-fold, . . . of ¼ of the wavelength) from the tip of the coupling electrode 102 as an anti-node where the amplitude of the sine wave reaches the maximum (as described above). For this reason, it is necessary to prevent mutual cancelation of the electric fields generated in portions of every odd-numbered fold of ½ of the wavelength (in other words, portions of 2-fold, 6-fold, 10-fold, . . . of ¼ of the wavelength) from the tip of the coupling electrode 102 in order to increase the size of the coupling electrode and then to radiate electric field signals over a wide range.

Hence, the present inventor suggests that bent portions be formed in places where charges with a polarity are accumulated in the coupling electrode so that charges with the same opposite polarity are gathered in a front direction toward the radiating direction of an electric field when a standing wave occurs.

Figure 12:
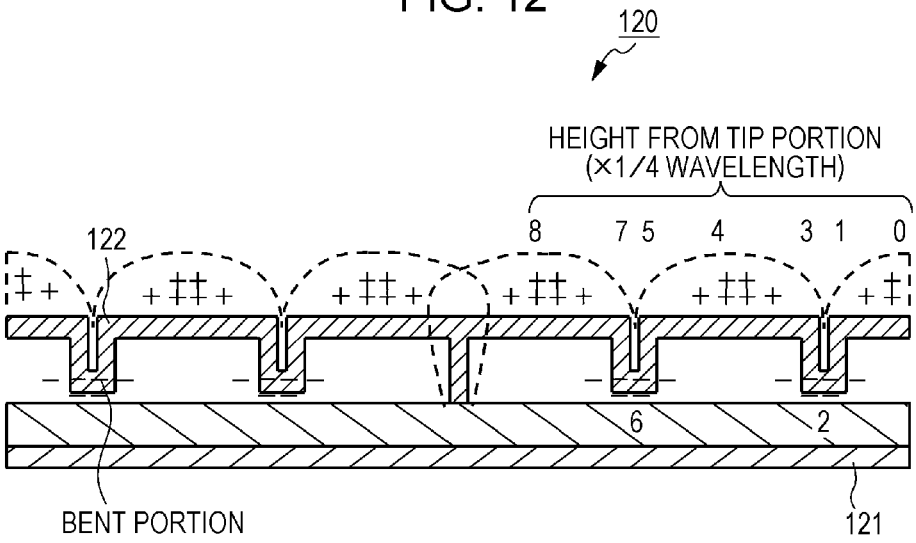
FIG. 12 is a diagram showing the state where charges are accumulated in a coupling electrode in a high-frequency coupler where the coupling electrode, which has a length from the root to the tip of ½ of the wavelength or more and formed with bent portions in every odd-numbered fold of ½ of the wavelength from the tip of the coupling electrode, is mounted in a ground circuit when the coupling electrode is input with high-frequency signals.
Figure 13:
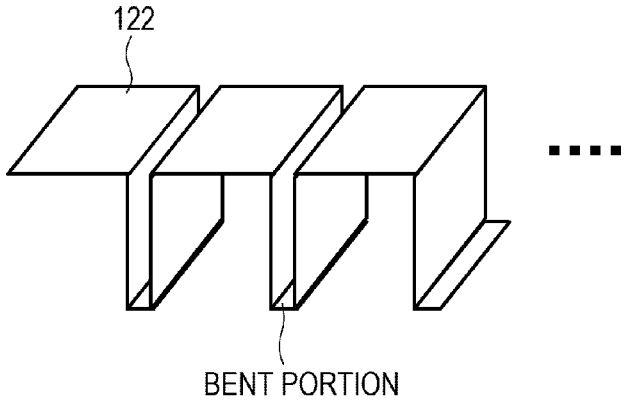
FIG. 13 is a perspective diagram showing the coupling electrode formed with bent portions.

FIG. 12 shows the state of a high-frequency coupler 120 formed by mounting on a ground board 121 a coupling electrode 122 that has the length of ½ of the wavelength from the root to the tip and is formed with bent portions in portions of every odd-numbered fold of ½ of the wavelength (in other words, portions of 2-fold, 6-fold, 10-fold, . . . of ¼ of the wavelength) from the tip of the coupling electrode 122, in which charges are accumulated in the coupling electrode 122 when a high-frequency signal is input to the coupling electrode 122. In addition, in the same drawing, the electric field generated from the coupling electrode 122 is indicated by dotted lines. FIG. 13 also shows a perspective view of the coupling electrode 122 in the state where bent portions are formed in portions of every odd-numbered fold of ½ of the wavelength from the tip of the coupling electrode 122 (however, the width in the depth direction is assumed to be a negligible size with respect to the length of a wavelength).

FIG. 12 shows the length of the coupling electrode 122 from the tip portion with ¼ of the wavelength as one unit. Charges with the same polarity are accumulated in portions of every one wavelength (in other words, portions of 0-fold, 4-fold, 8-fold, . . . of ¼ of the wavelength) from the tip of the coupling electrode 122. Moreover, the portions of every odd-numbered fold of ½ of the wavelength (in other words, portions of 2-fold, 6-fold, 10-fold, . . . of ¼ of the wavelength) from the tip of the coupling electrode 122 accumulates the charge with different polarity from the above, and are formed with the bent portions.

On the front surface toward the radiating direction of the electric field of the coupling electrode 122, only the portions of every one wavelength (in other words, portions of 0-fold, 4-fold, 8-fold, . . . of ¼ of the wavelength) from the tip of the coupling electrode 122 are gathered, and the charges distributed on the front surface have the same polarity. On the other hand, in the portions of every odd-numbered fold of ½ of the wavelength (in other words, portions of 2-fold, 6-fold, 10-fold, . . . of ¼ of the wavelength) from the tip of the coupling electrode 122, charges with the opposite polarity to the above are accumulated, but charges with the other polarity are gathered on a face in the rear side separated from the surface of the coupling electrode 122 (the communication surface where an electric field for communication is radiated) by being formed with bent portions. Put another way, charges with the same polarity are accumulated in adjacent reservoirs of the charges in the front face toward the radiating direction of the electric field of the coupling electrode 122. Therefore, an electric field cancelling another electric field acting toward the radiating direction in the front face of the radiating direction of the electric field does not act on the place where charges with a different polarity are accumulated.

Figure 14:
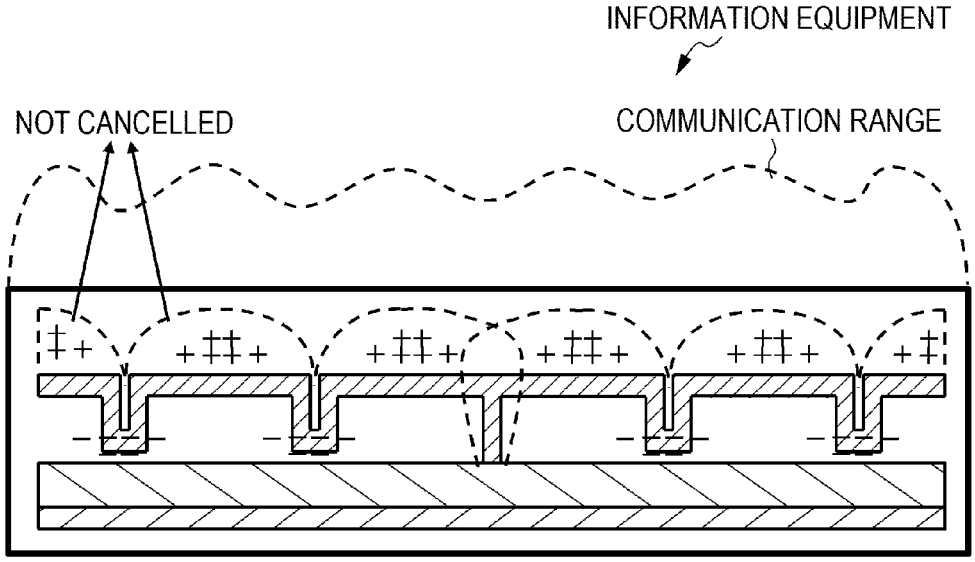
FIG. 14 is a diagram showing the state where the high-frequency coupler shown in FIG. 12 is accommodated in the information equipment.

FIG. 14 shows the state where the high-frequency coupler 120 shown in FIG. 12 is accommodated in information equipment. In addition, in the same drawing, the electric field occurring from the coupling electrode 122 is indicated by dotted lines. The range within which the electric field radiated from the housing surface of the information equipment reaches is a communication range. As shown in the drawing, as a result of stopping the cancelation of the electric fields in both of the front face and the rear face of the coupling electrode 122 as the charges with the different polarities are gathered in respective faces, a place with a low intensity of the electric field, that is, a dead-point (null point) is not generated, and therefore, stable communication is possible over a wide range in the transverse direction.

According to the composition example of the high-frequency coupler shown in FIGS. 12 to 14, since the communication range can be expanded mainly from the center to the transverse direction of the coupling electrode, users can conduct stable communication without having to exactly bring marks of target points into contact for alignment when, for example, information equipment incorporated with high-frequency couplers are made to face each other.

The present application contains subject matter related to that disclosed in Japanese Priority Patent Application JP 2010-055639 filed in the Japan Patent Office on Mar. 12, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

The invention claimed is:

1. A high-frequency coupler comprising:

a ground;

a coupling electrode which faces the ground and is supported so as to be separated by a negligible height with respect to a wavelength of a high-frequency signal; and a resonating unit to increase a current flowing into the coupling electrode via a transmission path, wherein the coupling electrode has bent portions in places where charges with a first polarity are accumulated so that charges with a second polarity are gathered in a front face toward a radiating direction of an electric field when the high-frequency signal is input to the coupling electrode via the transmission path and a standing wave occurs, and wherein an infinitesimal dipole constituted by a line connecting a center of a charges accumulated in the coupling electrode and a center of mirror-image charges accumulated in the ground is formed, and the high-frequency signal is transmitted toward a high-frequency coupler of a communication partner side arranged to face each other so that an angle θ formed in a direction of the infinitesimal dipole is substantially 0 degrees.

2. The high-frequency coupler according to claim 1, wherein the bent portions are formed in portions of every odd-numbered fold of about ½ of the wavelength from a tip of the coupling electrode.

3. A communication device comprising:

a communication circuit unit to perform a process of a high-frequency signal transmitting data;

a transmission path of a high-frequency signal connected to the communication circuit unit;

a ground;

a coupling electrode which faces the ground and is supported so as to be separated by a negligible height with respect to a wavelength of the high-frequency signal; and a resonating unit to increase a current flowing into the coupling electrode via the transmission path, wherein the coupling electrode has bent portions in places where charges with a first polarity are accumulated so that charges with a second polarity are gathered in a front face toward a radiating direction of an electric field when the high-frequency signal is input to the coupling electrode via the transmission path and a standing wave occurs, and wherein an infinitesimal dipole constituted by a line connecting a center of the charges accumulated in the coupling electrode and a center of mirror-image charges accumulated in the ground is formed, and the high-frequency signal is transmitted toward a high- frequency coupler of a communication partner side arranged to face each other so that an angle θ formed in a direction of the infinitesimal dipole is substantially 0 degrees.

4. The communication device according to claim 3, wherein the bent portions are formed in portions of every odd-numbered fold of about ½ of the wavelength from a tip of the coupling electrode.

* * * * *